US009926499B2

(12) United States Patent
Merdrignac et al.

(10) Patent No.: US 9,926,499 B2
(45) Date of Patent: Mar. 27, 2018

(54) PROCESS FOR REFINING A HYDROCARBON FEEDSTOCK OF THE VACUUM RESIDUE TYPE USING SELECTIVE DEASPHALTING, A HYDROTREATMENT AND A CONVERSION OF THE VACUUM RESIDUE FOR PRODUCTION OF GASOLINE AND LIGHT OLEFINS

(71) Applicant: IFP ENERGIES NOUVELLES, Rueil-Malmaison Cedex (FR)

(72) Inventors: Isabelle Merdrignac, Chaponnay (FR); Jerome Majcher, Lyons (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 14/332,567

(22) Filed: Jul. 16, 2014

(65) Prior Publication Data

US 2015/0021234 A1 Jan. 22, 2015

(30) Foreign Application Priority Data

Jul. 19, 2013 (FR) ..... 13 57138

(51) Int. Cl.

| | |
|---|---|
| ***C10G 67/04*** | (2006.01) |
| ***C10G 69/04*** | (2006.01) |
| ***C10G 67/14*** | (2006.01) |
| ***C10G 11/18*** | (2006.01) |
| ***C10G 21/00*** | (2006.01) |
| ***C10G 21/14*** | (2006.01) |

(52) U.S. Cl.

CPC ..... *C10G 69/04* (2013.01); *C10G 11/18* (2013.01); *C10G 21/003* (2013.01); *C10G 21/14* (2013.01); *C10G 67/14* (2013.01); *C10G 2300/1077* (2013.01); *C10G 2400/02* (2013.01); *C10G 2400/20* (2013.01)

(58) Field of Classification Search

CPC ..... C10G 67/0454; C10G 67/0463; C10G 67/0472; C10G 67/0481; C10G 67/049; C10G 21/003

USPC ..... 208/86, 309

See application file for complete search history.

(56) References Cited

U.S. PATENT DOCUMENTS

| | | | | |
|---|---|---|---|---|
| 2,925,374 A | | 2/1960 | Gwin et al. | |
| 3,278,415 A | | 10/1966 | Doberenz et al. | |
| 3,287,254 A | * | 11/1966 | Paterson | C10G 21/003 208/309 |
| 4,278,529 A | * | 7/1981 | Gearhart | C10G 1/045 208/309 |
| 4,493,765 A | * | 1/1985 | Long | C10G 21/003 208/309 |
| 5,092,983 A | * | 3/1992 | Eppig | B01D 11/02 208/13 |
| 7,279,090 B2 | | 10/2007 | Colyar et al. | |
| 8,636,896 B2 | | 1/2014 | Gueret et al. | |
| 2005/0006279 A1 | | 1/2005 | Gueret et al. | |
| 2006/0118463 A1 | | 6/2006 | Colyar et al. | |
| 2011/0062055 A1 | | 3/2011 | Gueret et al. | |

FOREIGN PATENT DOCUMENTS

EP 1505142 A1 2/2005

OTHER PUBLICATIONS

Search Report from corresponding French Patent Application No. 13/57138 dated Mar. 28, 2014.

* cited by examiner

*Primary Examiner* — Michelle Stein

(74) *Attorney, Agent, or Firm* — Millen White Zelano & Branigan, PC

(57) ABSTRACT

The invention relates to a process for refining a heavy feedstock of the vacuum residue type. Selective deasphalting of the feedstock is conducted in a single-stage liquid/liquid extraction in an extractant. Extraction is carried out by means of a mixture of at least one polar solvent and at least one apolar solvent, to obtain an asphalt phase and a deasphalted oil (DAO) phase. The proportions of polar solvent and apolar solvent in the solvent mixture are adjusted according to properties of the feedstock, desired yield of asphalt and/or desired quality of the DAO. Deasphalting is implemented under subcritical conditions. At least a part of the DAO is subjected to hydrotreatment. At least a part of the effluent originating from the hydrotreatment is subjected to catalytic cracking in at least one fluidized-bed reactor under conditions allowing a gasoline fraction and/or a light olefins fraction to be produced.

15 Claims, No Drawings

PROCESS FOR REFINING A HYDROCARBON FEEDSTOCK OF THE VACUUM RESIDUE TYPE USING SELECTIVE DEASPHALTING, A HYDROTREATMENT AND A CONVERSION OF THE VACUUM RESIDUE FOR PRODUCTION OF GASOLINE AND LIGHT OLEFINS

FIELD OF THE INVENTION

The present invention relates to a novel process for refining a heavy hydrocarbon feedstock of the vacuum residue type allowing the hydrotreatment and conversion of feedstocks with very high sulphur, asphaltene and metals contents and for maximizing the production of gasoline and/or light olefins.

Linking a fixed-bed residue hydrotreatment unit (commonly called "Resid Desulphurization Unit" or RDS) and a residue fluidized-bed catalytic cracking (RFCC) unit with a view to maximizing the production of gasolines and/or light olefins is particularly in demand as the low metals content and low Conradson carbon residue (CCR) of the cut leaving the RDS unit allows optimized utilization of the RFCC unit. The low metals content allows economies in terms of operating costs of the unit (catalytic cost), whereas the low Conradson carbon content makes it possible to maximize the yields of light fractions (gasoline, olefins, etc.) leaving the RFCC unit. The advantage of linking a RDS hydrotreatment unit and a residue fluidized-bed catalytic cracking RFCC unit, hereinafter called RDS+RFCC scheme, is that gasoline and/or light olefin cuts are obtained, with increased selectivity, that are of good quality and generally do not require post-hydrotreatment, or else require post-hydrotreatment that is much less harsh than in the case of schemes involving conversion units in place of the RDS units.

The RDS+RFCC scheme is incompatible with the objective of a maximized yield of gasoline and/or light olefins starting from heavy feedstocks of the vacuum residue type. The limitations are mainly due to the preliminary treatment of the feed required for this type of feedstock upstream of the RDS unit. In fact, heavy feedstocks of the vacuum residue type are feedstocks that are difficult to treat and contain impurities at levels (metals contents greater than 70 ppm, or even greater than 200 ppm) that are unsuitable for the RDS+RFCC scheme.

Starting from a heavy feedstock of the vacuum residue type, the upcycling schemes currently used comprise a preliminary stage of conversion of the vacuum residue feedstock in conversion units such as visbreaking units, coking units, units for ebullating-bed hydroconversion or even for circulating fluidized bed hydroconversion followed by dedicated stages of hydrotreatment of the cracked cuts. These conversion units pose operating difficulties of management of the unconverted fraction (coke, unconverted oil, etc.), of sedimentation or even of instability of the outgoing heavy fractions. Moreover, the aforementioned units for conversion of residues have a selectivity of conversion directed towards obtaining diesel fuel cuts. The yields of gasoline and/or light olefins are disadvantaged as a result. Moreover, the properties of the light cuts (gasoline, kerosene, diesel fuel) leaving the conversion units are of poor quality and definitely require a post-treatment before they are sent to the final fuel pools.

The applicant proposes an optimized process for producing gasoline and/or light olefins such as propylene starting from a feedstock of the vacuum residue type. It was found that by carrying out a pretreatment of a vacuum residue feedstock comprising a selective deasphalting stage, it is possible to obtain a yield of deasphalted oil ("DAO") that is improved relative to a conventional deasphalting while maintaining a sufficient quality of DAO for it to be sent to an RDS+RFCC unit and consequently makes it possible to maximize the production of light olefins and gasoline. The selective deasphalting stage used in the process of the invention allows selective removal of the so-called final asphalt fraction contained in the vacuum residue, i.e. the fraction specifically containing the structures that are refractory to the subsequent stages of the refining process (RDS+RFCC).

An advantage of the process according to the invention is that it allows a vacuum residue feedstock that has been pretreated, and therefore adapted qualitatively to allow maximized production of light olefins and/or gasoline, to be sent quantitatively to the RDS+RFCC units.

Object of the Invention

The present invention relates to a process for refining a heavy feedstock of the vacuum residue type having a boiling point above 400° C., a density greater than 0.96, a content of C7 asphaltenes greater than 4 wt % of C7 asphaltenes relative to the total weight of the feedstock and/or a Conradson carbon content greater than 10 wt % of CCR relative to the total weight of the feedstock, said process comprising the following stages:

a) a stage of selective deasphalting of the feedstock by a single-stage liquid/liquid extraction in an extractant, said extraction being carried out by means of a mixture of at least one polar solvent and at least one apolar solvent, so as to obtain an asphalt phase and a deasphalted oil (DAO) phase, the proportions of said polar solvent and said apolar solvent in the solvent mixture being adjusted according to the properties of the feedstock, according to the desired yield of asphalt and/or according to the desired quality of the DAO, said deasphalting stage being carried out under the subcritical conditions for the mixture of solvents, b) a stage of hydrotreatment of at least a part of the deasphalted oil (DAO) phase originating from stage a) in the presence of hydrogen in at least one fixed-bed reactor containing at least one hydrodemetallization catalyst under conditions allowing an effluent to be obtained with a reduced content of metals and Conradson carbon, d) a stage of catalytic cracking of at least a part of the effluent from stage b) in at least one fluidized-bed reactor under conditions allowing a gasoline fraction and/or a light olefins fraction to be produced.

The principle of selective deasphalting is based on a separation of a petroleum residue by precipitation into two phases: i) a so-called "deasphalted oil" phase, also called "oil matrix" or "oil phase" or DAO (De-Asphalted Oil); and ii) a phase called "asphalt" or sometimes "pitch". Schemes based on a conventional deasphalting suffer from limitations in terms of yield and flexibility with respect to the upcycling envisaged for the petroleum residues. The use of solvents or a mixture of solvents of the paraffinic type in conventional deasphalting suffers in particular from a limitation on yield of deasphalted oil (DAO), which increases with the molecular weight of the solvent (up to C6/C7 solvent) and then levels off at a threshold specific to each feedstock and each solvent.

Stage a) of selective deasphalting according to the invention makes it possible to go further in maintaining dissolution, in the DAO oil matrix, of some or all of the polar structures of the heavy resins and of the asphaltenes that are the main constituents of the asphalt phase in conventional deasphalting, and that are not refractory to the downstream upcycling stages.

Advantageously according to the invention, the polar solvent used is selected from the pure aromatic or naphtheno-aromatic solvents, the polar solvents comprising hetero-elements, or a mixture thereof or cuts rich in aromatics such as cuts from FCC (Fluid Catalytic Cracking), cuts derived from coal, from biomass or from biomass/coal mixture.

Advantageously according to the invention, the apolar solvent used comprises a solvent comprising saturated hydrocarbons having a carbon number greater than or equal to 2, preferably comprised between 2 and 9. These solvents are used pure or in a mixture (for example: mixture of alkanes and/or of cycloalkanes or else light petroleum cuts of the naphtha type).

Advantageously according to the invention, the ratio of the volume of the mixture of polar and apolar solvents to the weight of the feedstock is between 1/1 and 10/1 expressed as liters per kilograms.

The feedstock according to the invention is obtained from the vacuum distillation of crude oil. Advantageously according to the invention, the feedstock is a heavy feedstock that can originate from vacuum distillation of crude oil containing impurities, in particular sulphur and metals or a vacuum residue originating from the direct liquefaction of coal or else an H-Coal™ vacuum residue or else a vacuum residue originating from direct liquefaction of lignocellulosic biomass alone or in a mixture with coal and/or a vacuum residue of crude oil.

Advantageously according to the invention, stage b) is carried out with at least one catalyst providing mainly hydrodesulphurization and at least one catalyst providing mainly hydrodemetallization under conditions allowing a liquid effluent to be obtained with reduced content of metals, of Conradson carbon and of sulphur.

Advantageously according to the invention, stage b) is carried out at a pressure comprised between 2 and 35 MPa, a temperature comprised between 300 and 500° C. and a liquid hourly space velocity comprised between 0.1 and 5 $h^{-1}$.

Advantageously according to the invention, the effluent originating from stage b) is subjected to a separation stage c) making it possible to separate at least:

- a gaseous fraction;
- a gasoline cut;
- a diesel fuel cut;
- a vacuum distillate cut;
- a vacuum residue cut.

Advantageously according to the invention, stage d) is carried out on at least one mixture comprising at least one vacuum distillate cut and/or one vacuum residue cut.

DETAILED DESCRIPTION OF THE INVENTION

Feedstock

The feedstock according to the process of the invention is a heavy feedstock originating from the vacuum distillation of crude oil containing impurities, in particular sulphur and metals, with a boiling point above 400° C., advantageously above 450° C., preferably above 480° C.

The feedstock according to the process of the invention can be a vacuum residue originating from so-called conventional crude (degrees API)>20°, heavy crude (degrees API between 10 and 20°) or extra heavy crude (degrees API<10°).

Advantageously according to the invention, the feedstock is a heavy feedstock that can originate from the vacuum distillation of crude oil containing impurities, in particular sulphur and metals or a vacuum residue originating from direct liquefaction of coal or else an H-Coal™ vacuum residue or else a vacuum residue originating from direct liquefaction of lignocellulosic biomass alone or in a mixture with coal and/or a vacuum residue from crude oil.

The boiling point of the vacuum residue feedstock according to the invention is above 400° C., preferably above 450° C., more preferably above 480° C.

The feedstock according to the invention has a density greater than 0.96, preferably greater than 0.98, more preferably greater than 1.00;

- a content of C7 asphaltenes greater than 4% w/w (percentage expressed as weight of C7 asphaltenes relative to the weight of the feedstock, measured according to the method NF T60-115), preferably greater than 8% w/w, more preferably greater than 14% w/w;
- and/or a Conradson carbon (also called CCR) greater than 10% w/w (percentage expressed as weight of CCR relative to the weight of the feedstock), preferably greater than 14% w/w, more preferably greater than 20% w/w.

Advantageously, the feedstock according to the invention has a sulphur content greater than 0.5% w/w (percentage expressed as weight of sulphur relative to the weight of the feedstock), preferably greater than 2% w/w, more preferably greater than 4% w/w;

- and/or a metals content greater than 70 ppm (parts per million expressed as weight of metals relative to the weight of the feedstock), preferably greater than 100 ppm, more preferably greater than 200 ppm.

Stage a) Selective Deasphalting

Throughout this text, by the expression "mixture of solvents according to the invention" is meant a mixture of at least one polar solvent and at least one apolar solvent according to the invention.

According to the process of the invention, the heavy hydrocarbon feedstock is subjected to a stage a) of selective deasphalting carried out in a single stage. Said stage a) of selective deasphalting comprises bringing said feedstock into contact with a mixture of at least one polar solvent and at least one apolar solvent in an extractant. The proportions of the polar solvent and of the apolar solvent are adjusted according to the properties of the feedstock, according to the desired degree of extraction of asphalt and/or according to the desired qualities of the DAO.

Stage a) of selective deasphalting makes it possible to go further in maintaining the dissolution, in the DAO oil matrix, of some or all of the polar structures of the heavy resins and asphaltenes that are the main constituents of the asphalt phase in conventional deasphalting, and that are not refractory to the downstream upcycling stages. Stage a) of selective deasphalting thus makes it possible to select what types of polar structures remain solubilized in the DAO oil matrix. Consequently, stage a) of selective deasphalting makes it possible to extract selectively from the feedstock a so-called final asphalt fraction rich in impurities and in compounds refractory to upcycling. A DAO oil that can be upcycled is thus obtained, moreover with a greater yield than in the context of conventional deasphalting.

The asphalt extracted according to the process of the invention corresponds to the final asphalt essentially consisting of refractory polyaromatic and/or heteroatomic molecular structures. The yield of asphalt is correlated with the yield of DAO oil by the following relation:

Yield of asphalt=100−[yield of DAO oil]

Stage a) of selective deasphalting can be carried out in an extraction column, or in a mixer-decanter. This stage is carried out by a single-stage liquid/liquid extraction.

The liquid/liquid extraction in stage a) is performed under subcritical conditions for the mixture of solvents, i.e. at a temperature below the critical temperature of the mixture of solvents. The extraction temperature is advantageously between 50 and 350° C., preferably between 90 and 320° C., more preferably between 150 and 310° C. and the pressure is advantageously between 0.1 and 6 MPa.

The ratio of the volume of the solvent mixture according to the invention (volume of polar solvent+volume of apolar solvent) to the weight of the feedstock is generally comprised between 1/1 and 10/1, preferably between 2/1 to 8/1, expressed as liters per kilograms.

The mixture of solvents according to the invention used in stage a) is a mixture of at least one polar solvent and at least one apolar solvent.

The polar solvent used can be selected from the pure aromatic or naphtheno-aromatic solvents, the polar solvents comprising hetero-elements, or a mixture thereof. The aromatic solvent is advantageously selected from the monoaromatic hydrocarbons, preferably benzene, toluene or the xylenes, alone or in a mixture; the diaromatics or polyaromatics; the naphtheno hydrocarbons-aromatic hydrocarbons such as tetrahydronaphthalene or indane; the heteroatomic aromatic hydrocarbons (oxygen-containing, nitrogen-containing, sulphur-containing) or any other family of compounds having a more polar character than the saturated hydrocarbons for example dimethylsulphoxide (DMSO), dimethyl formamide (DMF), tetrahydrofuran (THF). The polar solvent used in the process according to the invention can also be a cut that is rich in aromatics. The cuts rich in aromatics according to the invention can be for example cuts originating from FCC (Fluid Catalytic Cracking) such as heavy gasoline or LCO (light cycle oil). There may also be mentioned the cuts derived from coal, from biomass or from biomass/coal mixture optionally with a residual petroleum feedstock after thermochemical conversion with or without hydrogen, with or without catalyst. Preferably, the polar solvent used is a monoaromatic hydrocarbon, pure or in a mixture with another aromatic hydrocarbon.

The apolar solvent used is preferably a solvent comprising saturated hydrocarbons, said saturated hydrocarbons having a carbon number greater than or equal to 2, preferably comprised between 2 and 9. These saturated hydrocarbon solvents are used pure or in a mixture (for example: mixture of alkanes and/or of cycloalkanes or else of light petroleum cuts of the naphtha type).

Advantageously, the boiling point of the polar solvent of the solvent mixture according to the invention is above the boiling point of the apolar solvent.

Combined with the temperature and pressure conditions of the extraction according to the invention, the variation of the proportions of the polar solvent or solvents and the apolar solvent or solvents constitutes a real key for controlling stage a) of selective deasphalting according to the invention. For example, for a given feedstock, the higher the proportion and/or the intrinsic polarity of the polar solvent in the solvent mixture, the higher the yield of deasphalted oil, a part of the polar structures of the feedstock remaining solubilized and/or dispersed in the DAO oil phase. Lowering the proportion of polar solvent in the mixture has the effect of increasing the quantity of asphaltene phase collected. Thus, stage a) of selective deasphalting according to the invention makes it possible to extract selectively, whatever the feedstock, a so-called final asphalt fraction, rich in impurities and in compounds refractory to the subsequent stages of the refining process, while at least a part of the polar structures of the heavy resins and asphaltenes that are the least polar and are not refractory to the subsequent stages of the process of the invention is left solubilized in the oil matrix.

Advantageously, the proportion of the polar solvent in the mixture of the polar solvent and of the apolar solvent is comprised between 0.1 and 99.9%, preferably between 1 and 90%, more preferably between 1 and 80%.

The percentage of polar solvent in the mixture of polar and apolar solvent depends on the nature of the feedstock, as the molecular structures making up a feedstock vary from one feedstock to another. Not all feedstocks have an identical refractory character. The level of asphalt to be extracted is not necessarily the same, depending on the nature of the feedstock.

The nature of the feedstock also depends on its origin: petroleum, derived from coal, or of the biomass type.

Stage a) of selective deasphalting also has the advantage of allowing a considerable improvement in yield of deasphalted oil (DAO) over a whole range as yet unexplored by conventional deasphalting. For a given feedstock of which the yield of DAO oil obtained has levelled off at 75% (extraction with normal heptane), selective deasphalting makes it possible to cover, by adjusting the proportion of polar solvent and of apolar solvent, the range 75-99.9% of yield of DAO oil. The yield of DAO oil at the end of stage a), whatever the feedstock, is advantageously comprised between 50 and 99.9%, preferably between 75 and 99.9%, more preferably between 80 and 99.9%.

Implementation of stage a) offers the advantage of improving the properties of the starting feedstocks by obtaining a deasphalted oil in particular with a lower sulphur content and a lower metals content and less rich in Conradson carbon (CCR), which allows easier or more efficient treatment in stages b) and c), thus maximizing production of light olefins and gasoline.

Stage b) Hydrotreatment of the DAO Oil Phase

Stage b) of hydrotreatment of at least a part of the DAO oil phase originating from stage a) is carried out under conditions of fixed-bed hydrotreatment. Stage b) is carried out under conditions known to a person skilled in the art.

According to the invention, stage b) is carried out at a pressure comprised between 2 and 35 MPa and a temperature comprised between 300 and 500° C. and a liquid hourly space velocity between 0.1 and 5 $h^{-1}$, preferably at a pressure comprised between 10 and 20 MPa and a temperature comprised between 340 and 420° C. and a liquid hourly space velocity comprised between 0.1 and 2 $h^{-1}$.

By hydrotreatment (HDT) is meant in particular reactions of hydrodesulphurization (HDS), reactions of hydrodemetallization (HDM), accompanied by reactions of hydrogenation, hydrodeoxygenation, hydrodenitrogenation, hydrodearomatization, hydroisomerization, hydrodealkylation, hydrocracking, hydrodeasphalting and reduction of Conradson carbon.

According to a preferred variant, the hydrotreatment stage comprises a first stage of hydrodemetallization comprising one or more zones of fixed-bed hydrodemetallization optionally preceded by at least two hydrotreatment guard zones, and a second subsequent stage of hydrodesulphurization comprising one or more zones of fixed-bed hydrodesulphurization and in which during the first so-called hydrodemetallization stage, under conditions of hydrodemetallization, the feedstock and hydrogen are passed over a hydrodemetallization catalyst, then during the subsequent second stage, under conditions of hydrodesulphurization, the effluent from the first stage is passed over a hydrodesulphurization catalyst. This process, known as HYVAHL-F™, is described in U.S. Pat. No. 5,417,846.

A person skilled in the art will readily understand that in the hydrodemetallization stage, primarily reactions of hydrodemetallization are carried out, but in parallel also a part of the reactions of hydrodesulphurization. Moreover, in the hydrodesulphurization stage, primarily reactions of hydrodesulphurization are carried out, but in parallel also a part of the reactions of hydrodemetallization.

In a preferred variant according to the invention, stage b) is implemented in one or more zones of fixed-bed hydrodesulphurization.

The hydrotreatment catalysts used are preferably known catalysts and are generally granular catalysts comprising, on a support, at least one metal or metal compound having a hydrodehydrogenating function. These catalysts are advantageously catalysts comprising at least one group VIII metal, generally selected from the group formed by nickel and/or cobalt, and/or at least one group VIB metal, preferably molybdenum and/or tungsten. For example, a catalyst will be used comprising from 0.5 to 10 wt % of nickel and preferably from 1 to 5 wt % of nickel (expressed as nickel oxide NiO) and from 1 to 30 wt % of molybdenum, preferably from 5 to 20 wt % of molybdenum (expressed as molybdenum oxide $MoO_3$) on a mineral support. This support will be selected, for example, from the group formed by alumina, silica, silica-aluminas, magnesium oxide, clays and mixtures of at least two of these minerals. Advantageously, this support contains other doping compounds, in particular oxides selected from the group formed by boron oxide, zirconium oxide, cerite, titanium dioxide, phosphoric anhydride and a mixture of these oxides. An alumina support is used most often, and very often an alumina support doped with phosphorus and optionally with boron. When phosphoric anhydride $P_2O_5$ is present, its concentration is less than 10 wt %. When boron trioxide $B_2O_5$ is present, its concentration is less than 10 wt %. The alumina used is usually a or alumina. This catalyst is most often in the form of extrudates. The total content of oxides of metals of groups VIB and VIII is often from 5 to 40 wt % and generally from 7 to 30 wt % and the weight ratio expressed as metal oxide, of metal (or metals) of group VIB to metal (or metals) of group VIII is generally 20 to 1 and most often 10 to 2.

In the case of a hydrotreatment stage including a hydrodemetallization stage (HDM), and then a hydrodesulphurization stage (HDS), specific catalysts appropriate to each stage are most often used. Catalysts usable in the HDM stage are mentioned for example in patents EP113297, EP113284, U.S. Pat. No. 5,221,656, U.S. Pat. No. 5,827,421, U.S. Pat. No. 7,119,045, U.S. Pat. No. 5,622,616 and U.S. Pat. No. 5,089,463. Hydrodemetallization catalysts are preferably used in switchable reactors. Catalysts usable in the hydrodesulphurization stage are mentioned for example in patents EP113297, EP113284, U.S. Pat. No. 6,589,908, U.S. Pat. No. 4,818,743 or U.S. Pat. No. 6,332,976. It is also possible to use a mixed catalyst that is active in hydrodemetallization and in hydrodesulphurization both for the hydrodemetallization section and for the hydrodesulphurization section as described in patent FR2940143. Before injecting the feedstock, the catalysts used in the process according to the present invention are preferably subjected to a sulphurization treatment (in-situ or ex-situ).

Stage c) Separation of the Effluent Originating from Stage b)

Advantageously according to the invention, the products obtained during stage b) are subjected to a separation stage c), advantageously leading to recovery of:

- a gaseous fraction;
- a gasoline cut having a boiling point between 20 and 150° C.;
- a diesel fuel cut having a boiling point between 150 and 375° C.;
- a vacuum distillate cut (vacuum gasoil or VGO);
- a vacuum residue cut (vacuum residue or VR).

Stage d) Catalytic Cracking

Advantageously, the refining process according to the invention comprises a stage of catalytic cracking carried out on a mixture comprising at least one vacuum distillate cut (VGO) and/or a vacuum residue cut (VR) advantageously originating from stage b). Advantageously said cuts originate from a prior separation stage c) following stage b).

Stage d) is carried out under conventional conditions of catalytic cracking that are well known to a person skilled in the art, in at least one fluidized-bed reactor so as to produce a gaseous fraction, a gasoline fraction, a Light Cycle Oil (LCO) fraction, a Heavy Cycle Oil (HCO) fraction, and slurry.

This stage can be carried out in a conventional manner known to a person skilled in the art under suitable conditions for residue cracking with a view to producing hydrocarbon products of lower molecular weight. Descriptions of operation and of catalysts usable in the context of fluidized-bed cracking in this stage are described for example in patent documents U.S. Pat. No. 4,695,370, EP-B-184517, U.S. Pat. No. 4,959,334, EP-B-323297, U.S. Pat. No. 4,965,232, U.S. Pat. No. 5,120,691, U.S. Pat. No. 5,344,554, U.S. Pat. No. 5,449,496, EP-A-485259, U.S. Pat. No. 5,286,690, U.S. Pat. No. 5,324,696 and EP-A-699224, the descriptions of which are considered to be incorporated in the present invention.

For example, a brief description of catalytic cracking (the first industrial application of which dates back to 1936 (HOUDRY process) or 1942 for catalyst use in a fluidized bed) will be found in ULLMANS ENCYCLOPEDIA OF INDUSTRIAL CHEMISTRY Volume A 18, 1991, pages 61 to 64. Usually a conventional catalyst is used comprising a matrix, optionally an additive and at least one zeolite. The quantity of zeolite is variable but is usually from about 3 to 60 wt %, often from about 6 to 50 wt % and most often from about 10 to 45 wt %. The zeolite is usually dispersed in the matrix. The quantity of additive is usually from about 0 to 30 wt % and often from about 0 to 20 wt %. The quantity of matrix represents the complement up to 100 wt %. The additive is generally selected from the group formed by the oxides of the metals of group IIA of the periodic table such as for example magnesium oxide or calcium oxide, the oxides of the rare earths and the titanates of the group IIA metals. The matrix is most often a silica, an alumina, a silica-alumina, a silica-magnesia, a clay or a mixture of two or more of these products. The zeolite most commonly used is zeolite Y. Cracking is carried out in an approximately vertical reactor either in ascending mode (riser), or in descending mode (dropper).

The choice of catalyst and of the operating conditions depend on the products required as a function of the feedstock treated, as is described for example in the article by M.

MARCILLY pages 990-991 published in the review of the Institut Français du Pétrole November-December 1975 pages 969-1006. Operation is usually at a temperature from about 450 to about 600° C., with residence times in the reactor of less than 1 minute, often from about 0.1 to about 50 seconds.

Stage d) of catalytic cracking is advantageously a stage of fluidized-bed catalytic cracking for example according to the process developed by the applicant called R2R. This stage can be carried out in a conventional manner known to a person skilled in the art under suitable conditions for cracking residue with a view to producing hydrocarbon products of lower molecular weight. Descriptions of operation and of catalysts usable in the context of fluidized-bed cracking in this stage d) are described for example in patent documents U.S. Pat. No. 4,695,370, EP-B-184517, U.S. Pat. No. 4,959,334, EP-B-323297, U.S. Pat. No. 4,965,232, U.S. Pat. No. 5,120,691, U.S. Pat. No. 5,344,554, U.S. Pat. No. 5,449,496, EP-A-485259, U.S. Pat. No. 5,286,690, U.S. Pat. No. 5,324,696 and EP-A-699224.

The fluidized-bed catalytic cracking reactor can operate with ascending flow or descending flow. Although this is not a preferred embodiment of the present invention, it can also be envisaged to carry out catalytic cracking in a moving-bed reactor.

The catalytic cracking catalysts particularly preferred are those that contain at least one zeolite usually in a mixture with a suitable matrix, for example alumina, silica, silica-alumina.

The process according to the invention offers various advantages, namely:

- the possibility of upcycling a feedstock of the vacuum residue type comprising high contents of impurities,
- obtaining maximized yields of products with high added value (naphtha, light olefins, etc.), better grades of products at the outlet of the RFCC unit and a drop in catalytic cost of the RFCC catalytic cracking unit,
- decrease in the proportion of hydrodemetallization catalyst (HDM) in favour of hydrodesulphurization catalyst (HDS) in the RDS hydrotreatment unit owing to lowering of the metals content in the deasphalted oil (DAO) originating from selective deasphalting according to the invention.
- attainment of very low levels of sulphur in the residual fractions at the outlet of the process when working on conventional vacuum residues at the inlet (apart from so-called "heavy" feedstocks), constituting fuel bases with high added value.

The following examples illustrate the present invention but without limiting its scope.

Without further elaboration, it is believed that one skilled in the art can, using the preceding description, utilize the present invention to its fullest extent.

The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French Application No. 13/57138, filed Jul. 19, 2013 are incorporated by reference herein

EXAMPLES

The following examples are carried out with a feedstock A comprising 100 wt % of vacuum residue of the Arabian Heavy 520+ type.

TABLE 1

| Characteristics of feedstock A | |
|---|---|
| Density 15/4 | 1.040 |
| Sulphur (wt %) | 5.45 |
| Conradson carbon (%) | 22 |
| C7 asphaltenes (wt %) (standard NF T60-115) | 14.6 |
| Ni + V (ppm) | 204 |

Example 1 (Comparative): Utilization of a Coking Unit

Example 1 constitutes a refining scheme conventionally encountered with this type of residue. Thermal conversion constitutes the only solution for extracting light cuts (naphtha, kerosene, gasoil) that are more easily upcyclable. Residue conversion can be obtained by several processes: visbreaking, coking, ebullating-bed hydroconversion or else circulating fluidized bed hydroconversion. Example 1 gives details of conversion of the feedstock using a coking unit.

TABLE 2

| Operating conditions of the coking unit | |
|---|---|
| T (° C.) at furnace outlet | 500 |
| Pressure (MPa) | 0.4 |
| Cycle time per coking still (h) | 16 |

The yields (Yld, expressed in percentage by weight), sulphur content (S, expressed in percentage by weight), metals content (Ni+V expressed in ppm) and Conradson carbon content (CCR, expressed in percentage by weight) of the cuts produced at the outlet of the coking unit are given in Table 3.

TABLE 3

Characteristics of the cuts leaving the coking unit

| Products | Yld (wt %) | S (wt %) | CCR (wt %) | Ni + V (ppm) |
|---|---|---|---|---|
| $H_2S$ | 1.87 | 94.12 | | |
| C1-C4 (gas) | 8.38 | 0 | | |
| Gasoline (PI-150) | 8.80 | 0.86 | | |
| Diesel fuel (150-375) | 29.23 | 2.51 | | |
| HCGO* (375-520) | 22.41 | 4.10 | 0.4 | 0.5 |
| Coke | 29.31 | 5.45 | | 696 |

*Heavy Coker Gas Oil

Example 2 (Comparative): Utilization of a Conventional Deasphalting Unit in Pretreatment of Linked RDS+RFCC The same feedstock A is used in example 2, but a residue desulphurization unit (RDS) is introduced. A conventional deasphalting unit (conventional SDA) is added upstream of the RDS unit for pretreating the feedstock.

The operating conditions of the conventional deasphalting unit and the yields and characteristics of the deasphalted oil (DAO) obtained are given in Tables 4 and 5. The solvent used is pentane (C5).

TABLE 4

| Operating conditions of the conventional SDA on feedstock A | |
|---|---|
| Ratio pentane/feedstock A (volume/weight) | 3/1 |
| Pressure (MPa) | 4 |
| Temperature (° C.) | 167 |

TABLE 5

| Yields and characteristics of the deasphalted oil (DAO) obtained | |
|---|---|
| DAO yield (wt %) | 70 |
| Density 15/4 | 0.995 |
| Sulphur (wt %) | 4.25 |
| Conradson carbon (wt %) | 12 |
| Ni + V (ppm) | 49 |

The fixed-bed RDS unit is used with deasphalted oil (DAO) originating from conventional SDA deasphalting, in the presence of hydrogen, under the operating conditions of start of cycle shown in Table 6.

TABLE 6

| Operating conditions of start of cycle of the RDS unit | |
|---|---|
| Catalyst | HF 858 - HT 438 |
| Temperature (° C.) | 370 |
| Pressure (MPa) | 150 |
| LHSV ($h^{-1}$) | 0.290 |
| Volume distribution HDM/HDS catalyst (%) | 44/56 |
| $H_2$/feedstock ($Nm^3/m^3$ feedstock) | 1000 |

The catalysts used are those marketed by the company Axens under the following commercial references: HF 858 and HT 438:

HF 858: catalyst primarily active in HDM;

HT 438: catalyst primarily active in HDS.

The yields (Yld, expressed in percentage by weight), sulphur content (S, expressed in percentage by weight), viscosity at 100° C. (cSt), metals content (Ni+V expressed in ppm) and Conradson carbon content (CCR, expressed in percentage by weight) of the cuts produced at the outlet of the RDS unit are given in Table 7.

TABLE 7

Characteristics of the cuts from the RDS unit

| Products | Yld (wt %) | S (wt %) | Viscosity 100° C. (cSt) | CCR (wt %) | Ni + V (ppm) |
|---|---|---|---|---|---|
| $NH_3$ | 0.20 | 0 | | | |
| $H_2S$ | 4.31 | 94.12 | | | |
| C1-C4 | 0.90 | 0 | | | |
| Gasoline (PI-150) | 1.12 | 0.004 | | | |
| Diesel fuel (150-375) | 11.19 | 0.014 | | | |
| VGO (375-520) | 30.53 | 0.110 | 7 | 0 | |
| VR (520+) | 53.05 | 0.390 | 115 | 5.1 | 4 |

with the hydrogen consumed representing 1.30 wt % of the feedstock.

This linking gives good quality of the outgoing products (sulphur, metals, CCR, etc.) as well as improved cycle times compared to hydrotreatment of a straight-run residue, but the loss of 30% of the initial feedstock in asphalt is too disadvantageous compared to the gains obtained.

Example 3 (According to the Invention): Utilization of a Selective Deasphalting Unit in Pretreatment of Linked RDS+RFCC Example 3 corresponds to example 2 with the sole difference that the selective deasphalting according to the invention (selective SDA stage a)) is used upstream of the RDS unit, with a flow rate of feedstock entering the SDA unit identical to that entering the RDS unit in example 2. The RDS unit is used under operating conditions identical to those given in example 2.

The operating conditions of the selective SDA unit according to the invention and the yields and characteristics of the deasphalted oil (DAO) obtained are given in Tables 8 and 9. A mixture of the apolar solvent (heptane) and the polar solvent (toluene) is used in a volume ratio 95/5.

TABLE 8

| Operating conditions of selective SDA on feedstock A | |
|---|---|
| Ratio of apolar/polar solvents (v/v) | 95/5 |
| Ratio of solvents/feedstock (v/w) | 5/1 |
| Pressure (MPa) | 2.5 |
| Temperature (° C.) | 240 |

TABLE 9

| Yields and characteristics of the deasphalted oil (DAO) obtained | |
|---|---|
| DAO yield (wt %) | 95 |
| Density 15/4 | 1.019 |
| Sulphur (wt %) | 5.18 |
| Conradson carbon (%) | 21 |
| Ni + V (ppm) | 177 |

The RDS fixed-bed hydrotreatment unit is used with deasphalted oil (DAO) originating from selective SDA, in the presence of hydrogen, under the operating conditions of start of cycle stated in Table 10.

TABLE 10

| Operating conditions of start of cycle of the RDS unit | |
|---|---|
| Catalyst | HF 858 - HT 438 |
| Temperature (° C.) | 370 |
| Pressure (MPa) | 150 |
| LHSV ($h^{-1}$) | 0.290 |
| Volume distribution HDM/HDS catalyst (%) | 44/56 |
| $H_2$/feedstock ($Nm^3/m^3$ feedstock) | 1000 |

The same catalysts are used as in example 2.

The yields (Yld, expressed in percentage by weight), sulphur content (S, expressed in percentage by weight), viscosity at 100° C. (cSt), metals content (Ni+V expressed in ppm) and Conradson carbon content (CCR, expressed in percentage by weight) of the cuts produced at the outlet of the RDS unit are given in Table 11.

TABLE 11

Characteristics of the cuts originating from the RDS unit

| Products | Yld (wt %) | S (wt %) | Viscosity 100° C. (cSt) | CCR (wt %) | Ni + V (ppm) |
|---|---|---|---|---|---|
| $NH_3$ | 0.40 | 0 | | | |
| $H_2S$ | 5.23 | 94.14 | | | |

TABLE 11-continued

| Characteristics of the cuts originating from the RDS unit | | | | | |
|---|---|---|---|---|---|
| Products | Yld (wt %) | S (wt %) | Viscosity 100° C. (cSt) | CCR (wt %) | Ni + V (ppm) |
| C1-C4 | 1.10 | 0 | | | |
| Gasoline (PI-150) | 1.03 | 0.005 | | | |
| Diesel fuel (150-375) | 10.31 | 0.018 | | | |
| VGO (375-520) | 30.87 | 0.143 | 10 | 0 | |
| VR (520+) | 52.59 | 0.507 | 170 | 12 | 9 |

with the hydrogen consumed representing 1.50 wt % of the feedstock.

It can be seen that the yields are very close to those obtained in example 2, whereas product qualities have degraded somewhat relative to the case in example 2 working on DAO (C5) under the same operating conditions. This loss of quality is, however, largely compensated by the gain in capacity: introduction of selective SDA makes it possible to extract a very small quantity of asphalt (5%) against a heavy loss (30%) in the case of conventional SDA.

All of the VGO produced as well as 35 wt % of the vacuum residue (VR) from the RDS unit is sent to a RFCC unit under the following operating conditions: operation at a temperature of 525° C. with a residence time in the reactor of 50 seconds. At the outlet of the RFCC unit there is production of a gasoline cut with a yield of 48%, or an overall yield of gasoline from the scheme of 23.5% (22.5% RFCC outlet+1.0% RDS outlet) with a sulphur content less than 100 ppm. This is to be compared with example 1 using a conventional scheme for direct conversion of Arabian Heavy residue, in which an overall yield of gasoline from the scheme of 8.8% is obtained with a sulphur content of this gasoline greater than 8000 ppm.

The process according to the invention therefore makes it possible, through pretreatment by selective deasphalting, to hydrotreat and then convert an Arabian Heavy residue with an improved selectivity for gasoline and light olefins and improved product quality.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for refining a heavy feedstock of the vacuum residue type having a boiling point above 400° C., a density greater than 0.96, a content of C7 asphaltenes greater than 4 wt % of C7 asphaltenes relative to the total weight of the feedstock and/or a Conradson carbon content greater than 10 wt % of CCR relative to the total weight of the feedstock, said feedstock further having a sulfur content of greater than 0.5% w/w, based on the weight of sulfur relative to the weight of the feedstock, and a metals content of at least ppm, based on the weight of metals relative to the weight of the feedstock said process comprising the following stages:

a) a stage of selective deasphalting said feedstock by a single-stage liquid/liquid extraction in an extractant, said extraction being carried out by means of a mixture of at least one polar solvent and at least one apolar solvent, so as to obtain an asphalt phase and a deasphalted oil (DAO) phase, the proportions of said polar solvent and said apolar solvent in the solvent mixture being adjusted according to the properties of said feedstock, according to the desired yield of asphalt and/or according to the desired quality of the DAO, said deasphalting stage being carried out under the subcritical conditions for the mixture of solvents, wherein said extraction is performed at a temperature between 150 and 320° C. and a pressure between 0.1 to 6 MPa, b) a stage of hydrotreatment wherein at least a part of the deasphalted oil (DAO) phase originating from stage a) is subjected to hydrotreatment in the presence of hydrogen in at least one fixed-bed reactor containing at least one hydrodemetallization catalyst under conditions allowing an effluent to be obtained with a reduced content of metals and Conradson carbon, and d) a stage of catalytic cracking of at least a part of the effluent originating from stage b) in at least one fluidized-bed reactor under conditions allowing a gasoline fraction and/or a light olefins fraction to be produced, wherein said polar solvent is selected from pure aromatic or naphtheno-aromatic solvents or a mixture thereof, said apolar solvent comprises a solvent comprising saturated hydrocarbon(s) having a carbon number between 2 and 9, the ratio of the volume of the mixture of polar and apolar solvents to the weight of the feedstock is between 2/1 and 8/1 expressed as liters per kilograms, and the proportion of the polar solvent in said mixture of at least one polar solvent and at least one apolar solvent is between 1 and 80%.

2. The process according to claim 1, wherein the feedstock is a feedstock originating from the vacuum distillation of crude oil.

3. The process according to claim 1, wherein stage b) is carried out with at least one catalyst providing mainly hydrodesulphurization under conditions allowing a liquid effluent to be obtained with a reduced content of metals, of Conradson carbon and of sulphur.

4. The process according to claim 1, wherein stage b) is carried out at a pressure between 2 and 35 MPa, a temperature between 300 and 500° C., and a liquid hourly space velocity between 0.1 and 5 $h^{-1}$.

5. The process according to claim 1, wherein, prior to stage d), the effluent from stage b) is subjected to a separation stage c) to separate at least:

a gaseous fraction;

a gasoline cut;

a diesel fuel cut;

a vacuum distillate cut; and/or a vacuum residue cut.

6. The process according to claim 5, wherein the effluent from stage b) that is treated in stage d) is said vacuum distillate cut, said vacuum residue cut, or a combination thereof.

7. The process according to claim 1, wherein said polar solvent is a cut rich in aromatics selected from cuts obtained from fluid catalytic cracking, and cuts derived from coal, from biomass or from a biomass/coal mixture.

8. The process according to claim 1, wherein said extraction in stage a) is conducted at a temperature between 240 and 320° C.

9. The process according to claim 4, wherein stage b) is carried out at a pressure between 10 and 20 MPa.

10. The process according to claim 4, wherein stage b) is carried out at a temperature between 340 and 420° C.

11. The process according to claim 4, wherein stage b) is carried out at a liquid hourly space velocity between 0.1 and 2 $h^{-1}$.

12. The process according to claim 4, wherein stage b) is carried out at a pressure between 10 and 20 MPa, a temperature between 340 and 420° C., and a liquid hourly space velocity comprised between 0.1 and 2 h-1.

13. The process according to claim 1, wherein said apolar solvent is heptane and said polar solvent is toluene.

14. The process according to claim 1, wherein said at least one polar solvent is selected from benzene, toluene, xylenes, tetrahydronaphthalene, and indane.

15. The process according to claim 1, wherein stage a) is carried out at a pressure between 2.5 and 6 MPa.

* * * * *